US006350358B1

(12) United States Patent
Ehmann et al.

(10) Patent No.: US 6,350,358 B1
(45) Date of Patent: Feb. 26, 2002

(54) ANODIC ELECTROPHORETIC COATING METHOD

(75) Inventors: Eduard Ehmann, Wuppertal; Manfred Evers, Velbert; Armin Göbel, Wetter; Bettina Vogt-Birnbrich, Solingen; Konstadinos Markou, Köln, all of (DE)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/600,476

(22) PCT Filed: Jan. 11, 1999

(86) PCT No.: PCT/EP99/00118

§ 371 Date: Aug. 21, 2000

§ 102(e) Date: Aug. 21, 2000

(87) PCT Pub. No.: WO99/36597

PCT Pub. Date: Jul. 22, 1999

(30) Foreign Application Priority Data

Jan. 17, 1998 (DE) ..... 198 01 605

(51) Int. Cl.[7] ..... C25D 13/24
(52) U.S. Cl. ..... 204/480; 204/496
(58) Field of Search ..... 204/480, 496; 205/101

(56) References Cited

U.S. PATENT DOCUMENTS 4,476,261 A 10/1984 Patzschke et al. ..... 523/402

OTHER PUBLICATIONS

Saatweber, Kathodische Elektrotauchlackierung, *Metalloberflache*, 31, 455–459, 1977, No month available.

Glasurit–Handbuch, 377, 1984, No month available.

Machu, Elektrotauchlackierung, Verlag Chemie GmbH Weinheim/Bergstrabe, 19074, 166, No date available.

Farbe und Lack, 103, 6/97, p. 26.

*Primary Examiner*—Kishor Mayekar
(74) *Attorney, Agent, or Firm*—Steven C. Benjamin

(57) ABSTRACT

A method for anodic electro-dip lacquer coating, wherein coating medium which is consumed in an anodic electro-dip bath is compensated for by an under-neutralised anodic replenishment material, wherein the replenishment material comprises A) a pigment-free aqueous binder vehicle component with a solids content of 40 to 70% by weight, an MEQ value of 15 to 40 and a content of organic solvent of ≦0.5% by weight, and B) a pigment-containing aqueous paste resin component with a solids content of 60 to 75% by weight, an MEQ value of 5 to 15 and a content of organic solvent of ≦1.0 % by weight, wherein A) and B) are present in a ratio by weight of 1:1 to 4:1 and the mixture of A) and B) has a solids content of 45 to 73% by weight, a solvent content of ≦0.75% by weight and an MEQ value which is 50 to 70% lower than the MEQ value of the electro-dip bath.

6 Claims, No Drawings

ANODIC ELECTROPHORETIC COATING METHOD

BACKGROUND OF THE INVENTION

The present invention relates to a method of producing an anodic electro-dip lacquer coating (ADL) using an electro-dip lacquer coating bath (ADL bath) which is low in solvents or free from solvents, wherein it is not necessary to perform electrodialysis in the EDL bath in order to maintain the bath and coating parameters. Therefore, it is also not necessary to discard ultrafiltrate on a regular basis.

The principle of anodic electro-dip lacquer coating (ADL) is described in the literature and has been proven in practice. Even after the introduction of cathodic electro-dip lacquer coating (CDL), anodic electro-dip coating is still a widely used coating method, particularly for the coating of industrial products. This is due firstly to the large number of existing anodic coating installations, and secondly to the good quality of anodic coating materials which is achieved nowadays. Moreover, certain materials, such as aluminium for example, can be coated more advantageously using anodic rather than cathodic electro-dip lacquer compositions. In anodic electro-dip lacquer coating a workpiece having an electrically conducting surface comprising a metal or an electrically conducting plastics material or comprising a substrate which is provided with an electrically conducting coating is placed in an aqueous ADL bath and is connected as an anode to a source of direct current.

The ADL bath consists of an aqueous dispersion, e.g. a suspension or emulsion, or of an aqueous solution of one or more binder vehicles which have been made at least partially dispersible or soluble in water by salt formation with organic or inorganic neutralizing agents, and of pigments, extenders, additives and other adjuvant substances which are dispersed therein.

When a DC electric current is applied, the polymer particles of the aqueous dispersion of the ADL bath migrate to the anode and react again there with the ions formed during the electrolysis of water, which proceeds simultaneously, to form a water-insoluble polymer which coagulates from the aqueous phase and is deposited, with the additives dispersed therein, as a lacquer film on the anode (Metalloberfläche 31(1977) 10, pages 455 to 459).

The usual ADL baths are operated continuously, i.e. the substrates described above are immersed and coated in an electro-dip lacquer tank filled with coating medium. Solids are thereby dragged out of the ADL bath and neutralizing agent is released in the ADL bath at the same time. In order to maintain the coating parameters and the quality of the coating constant, it is necessary to add replenishment material with an increased solids content to the ADL bath in order to compensate for the dragged-out solids and in order to compensate for the neutralizing agent released in the ADL bath so as to maintain the desired MEQ value.

In principle, there are two compensating procedures which are employed in order to compensate for the solids dragged out of the ADL bath and to compensate for the neutralizing agent released. The added replenishment material with an increased solids content is neutralized to a lesser extent than the ADL bath, and the neutralizing agent which is released is required for the dispersion and homogenisation of the replenishment material in the ADL bath and is thereby consumed. Compensation can also be effected using completely neutralized replenishment material. However, the equipment costs are then increased, since the neutralizing agent which is released has to be removed by means of (electro)dialysis (Glasurit-Handbuch 1984, page 377 and Willibald Machu "Elektrotauchlackierung", Verlag Chemie GmbH Weinheim/BergstraBe, 1974, page 166). The neutralizing agent which is released during the coating operation can also be removed by discarding ultrafiltrate on a regular basis. When compensation for the neutralizing agent which is released during the coating operation is effected by a replenishment material with a lesser degree of neutralization, the latter requires a high content, of up to about 15% by weight, of organic solvents, since it is otherwise unstable and its viscosity is too high, and it cannot be incorporated in the coating material, which can contain more than 90% water. Coating media of this type are described, for example, in DE-A-32 47 756.

In Farbe und Lack 103, Number 6/97, page 26, there is a reference to a new, environmentally friendly anodic single-component system (1 C system) for electro-dip lacquer coating. However, the replenishment paste, which is the form in which the replenishment material is supplied, still always contains 6% of organic solvents, and the bath still always contains 0.5% of organic solvents when it is in operation.

However, high solvent contents are undesirable on account of the pollution of outgoing air and waste water, wherein the total usage of substances is calculated based on legal regulations. In order to remove the neutralizing agent which is released during the coating operation, the cathodes in the ADL bath can also be accommodated in re-flushable dialysis cells (electrodialysis) and the neutralizing agent which is formed there can be discarded, or the coating material can be subjected, continuously or discontinuously, to an ultrafiltration step, with the ultrafiltrate which is thus produced being discarded on a regular basis. Electrodialysis devices of this type are not used in most ADL baths, on account of increased capital costs and higher maintenance and inspection costs. Moreover, regularly discarding ultrafiltrate or dialysate results in an increased cost of waste water processing and is therefore undesirable. The make-up of electro-dip lacquer baths with completely neutralized material, consisting of one or two components, is known from the literature (Glasurit-Handbuch 1984, page 377) and is described there using cathodic electro-dip lacquer coating as an example. As mentioned above, however, the use of electrodialysis and the discarding of dialysate is absolutely necessary in the procedure described there.

The object of the present invention was therefore to provide a method of producing an aqueous coating composition, which is low in solvents or free from solvents, for anodic electro-dip lacquer coating, for which, when it is used for the coating of conductive substrates in an ADL bath, it is not necessary to remove neutralizing agent which is released during the coating operation by an electrodialysis device in order to maintain the bath and coating parameters, and a considerable amount of ultrafiltrate does not have to be discarded on a regular basis.

Surprisingly, this object has been achieved by the use of an anodic replenishment material consisting of a pigment-free aqueous binder vehicle component and a pigment-containing aqueous paste resin component in order to compensate for the coating material consumed during electro-dip lacquer coating and for the neutralizing agent which is released at the same time, which anodic replenishment material is under-neutralized to an extent such that when added to the ADL bath it compensates for the neutralizing agent released there, and which nevertheless only contains small amounts of organic solvents.

SUMMARY OF THE INVENTION

Therefore, the present invention firstly relates to a method for anodic electro-dip lacquer coating, wherein coating medium which is consumed in an anodic electro-dip bath is compensated for by an under-neutralized anodic replenishment material, which is characterised in that the replenishment material comprises A) a pigment-free aqueous binder vehicle component with a solids content of 40 to 70% by weight, an MEQ value of 15 to 40 and a content of organic solvent of ≦0.5% by weight, and B) a pigment-containing aqueous paste resin component with a solids content of 60 to 75% by weight, an MEQ value of 5 to 15 and a content of organic solvent of ≦1.0% by weight, wherein A) and B) are present in a ratio by weight of 1:1 to 4:1 and the mixture of A) and B) has a solids content of 45 to 73% by weight, a solvent content of ≦0.75% by weight and an MEQ value which is 50 to 70% lower than the MEQ value of the electro-dip bath.

DETAILED DESCRIPTION OF THE INVENTION

The solids content of components A) and B) can be measured, according to DIN EN ISO 3251 for example, for 30 minutes at 180° C. The solids content of component A) is preferably 45 to 65% by weight. The solids content of component B) is preferably 60 to 73% by weight.

The MEQ value of component A) is preferably 20 to 35, and the MEQ value of component B) is preferably 5 to 10. The MEQ value is a measure of the content of neutralizing agent in an aqueous lacquer. It is defined as the amount of milliequivalents of neutralizing agent with respect to 100 g solids.

The content of organic solvent of component A) is preferably ≦0 4% by weight, and that of component B) is preferably ≦0.5% by weight.

The mixture ratio of component (A) to component (B) ranges from 1:1 to 4:1, preferably from 2:1 to 3.5:1 with respect to the weight of the aqueous component concerned.

The mixture has a solids content of 45 to 73% by weight, a solvent content of 0.75% by weight at most, and an MEQ value which is 50 to 70% less, preferably 60 to 70% less, than the MEQ value of the ADL bath in its state in which it is capable of coating.

Component (A) contains the binder vehicle or binder vehicles of the aqueous coating medium and also optionally contains a biocidal component, and contains crosslinking agents if necessary, and also optionally contains emulsifiers, film-forming agents, other additives such as neutral resins and customary lacquer additives such as light stabilisers and optical brighteners for example.

Component (B) contains one or more paste resins, pigments and/or extenders, optionally contains a biocidal component and contains crosslinking agents if necessary, and also optionally contains film-forming agents and customary lacquer additives as well as other additives, such as those which may be contained in component (A) for example.

Binder vehicle systems which are suitable for use as binder vehicles of component (A) comprise all those with an acid number of 20 to 150, preferably 20 to 120, and a hydroxyl number of 20 to 150, preferably 60 to 120, such as those which are known for aqueous coating systems, particularly for anodic electro-dip lacquer coatings.

Examples thereof include polyester, polyacrylate and polyurethane resins; modified polyester or polyurethane resins, such as alkyd resins for example, urethanised polyester resins or acrylated polyester or polyurethane resins, as well as mixtures of these resins. Polyester resins are preferred.

Examples of suitable polyester resins in component (A) include polyesters which contain carboxyl groups and hydroxyl groups and which have an acid number of 20 to 150 and a hydroxyl number of 20 to 150. These are produced by methods known to one skilled in the art, namely by the reaction of polyhydric alcohols with polyvalent carboxylic acids or carboxylic acid anhydrides, and optionally with aromatic and/or aliphatic monocarboxylic acids also. The necessary content of hydroxyl groups is obtained in the manner known in the art by suitably selecting the type and quantitative ratios of the starting materials. Carboxyl groups can be introduced, for example, by forming a semi-ester from a polyester resin, which has been produced previously and which contains hydroxyl groups, and acid anhydrides. Carboxyl groups can also be incorporated, for example, by the use of hydroxycarboxylic acids in conjunction during the condensation polymerisation reaction.

The dicarboxylic acids and the polyols can be aliphatic or aromatic dicarboxylic acids and polyols.

Examples of low molecular weight polyols which are used for the production of the polyesters include low molecular weight polyols, e.g. diols such as alkylene glycols, for example ethylene glycol, butylene glycol, hexanediol, hydrogenated bisphenol A and 2,2-butyl-ethylpropanediol, neopentyl glycol and/or other glycols such as dimethylolcyclohexane. Components of higher functionality or mixtures of mono-functional OH components with components of higher functionality can also be used, such as trimethylolpropane, pentaerythritol, glycerol or hexanetriol; polyethers which are condensates of glycols with alkylene oxides; or monoethers of glycols such as these, e.g. diethylene glycol monoethyl ether or tripropylene glycol monomethyl ether.

The acid component of the polyester preferably consists of low molecular weight dicarboxylic acids or anhydrides thereof which contain 2 to 18 carbon atoms in their molecule.

Examples of suitable acids include phthalic acid, isophthalic acid, terephthalic acid, tetrahydrophthalic acid, hexahydrophthalic acid, adipic acid, azelaic acid, sebacic acid, fumaric acid, maleic acid, glutaric acid, succinic acid, itaconic acid and/or 1,4-cyclohexane-dicarboxylic acid. Instead of these acids, the methyl esters or anhydrides thereof can also be used, provided that they exist. In order to obtain branched polyesters, it is also possible to add proportions of carboxylic acids of higher functionality, such as tri-functional carboxylic acids, trimellitic acid, malic acid, aconitic acid or bishydroxyethyl taurine, as well as dimethylolpropionic acid, dimethylolbutyric acid or bisanhydrides. Polycarboxylic acids which do not form cyclic anhydrides are preferred.

The polyester resins can also be modified, for example by the incorporation of unsaturated compounds or of compounds which contain isocyanate groups, or by partial or graft polymerisation with ethylenically unsaturated compounds.

Examples of polyesters which are preferred in component (A) include polyesters which contain carboxyl groups, and which have an acid number of 20 to 120 and a hydroxyl number of 20 to 150, preferably 60 to 120. For example, these can be the reaction products of di- and/or polyhydric aliphatic or cycloaliphatic saturated alcohols with aliphatic, cycloaliphatic and/or monocyclic aromatic di- or polybasic polycarboxylic acids and can optionally be the reaction products of linear or branched, saturated or unsaturated aliphatic and/or cycloaliphatic $C_3$ to $C_{20}$ monoalcohols or monocarboxylic acids. The quantitative ratios of the starting materials are calculated from the molar ratios which result in the desired acid numbers and hydroxyl numbers of the resin. The selection of the individual starting materials taking into account the intended use of the product is known to one skilled in the art.

The number average molecular weight Mn, as measured using polystyrene as the calibration substance, ranges from 1000 to 6000, and is preferably 2000 to 4000. Oil-free polyesters which contain carboxyl groups are particularly preferred, such as those described in DE-A-32 47 756 for example.

These polyesters preferably contain 0.3 to 3.0, most preferably 0.5 to 2.5 milliequivalents per gram of resin of aliphatic, cycloaliphatic and/or monocyclic aromatic dicarboxylic acids, which are incorporated by condensation. When using cyclic carboxylic acids, 0.8 to 2.0, preferably 0.9 to 1.8, most preferably 1.1 to 1.5 millimoles of these acids are advantageously bonded to the polyester via one carboxyl group only. Tri- and/or polybasic polycarboxylic acids, most preferably tri- and/or tetrabasic acids, are preferably used as polycarboxylic acids. The polyesters are produced in the manner known in the art by the condensation polymerization of the starting materials, a step-wise procedure preferably being employed to prevent the occurrence of turbidity and gel formation.

The esterification of what are preferably aromatic and cycloaliphatic dicarboxylic acids which are not capable of forming an intramolecular anhydride is preferably effected with dialcohols which either contain secondary OH groups or which contain primary OH groups which are sterically hindered due to substitution, a polyester which contains OH groups being formed by the use of excess alcohol. The alcohols preferably contain 2 to 21, most preferably 4 to 8 C atoms. The dicarboxylic acids preferably contain 5 to 10 C atoms, most preferably 6 C atoms.

Examples thereof include isophthalic acid, terephthalic acid, 1,3- and 1,4-cyclohexane-dicarboxylic acid, or alkyl-substituted dicarboxylic acids comprising butyl isophthalic acid. Isophthalic acid is particularly preferred. In order to obtain a branched product, a corresponding amount of a tricarboxylic acid such as trimellitic anhydride can be incorporated by condensation in the resin molecule in place of a proportion of the dicarboxylic acid. On the other hand, dimethyl esters, such as, dimethyl terephthalate or 1,4-cyclohexane-dicarboxylic acid dimethyl ester can also be introduced into the polyester by transesterification, optionally, in the presence of transesterification catalysts.

The dialcohols which are preferably used are neopentyl glycol, hydroxypivalic acid neopentyl glycol ester, 2,5-hexanediol, 1,4-bis(hydroxymethyl)cyclohexane, 1,1-isopyrilidine-bis-(p-phenoxy)-2-propanol and 2,2,4-trimethylpentanediol-1,3, as well as mixtures thereof.

Glycidyl esters of α-branched fatty acids, such as, versatic acid, can be used as the alcohol, because the fatty acid is incorporated in the molecule so that it is stable to hydrolysis. In special cases it is also possible to use epoxy resins, the epoxy groups of which have been reacted with monoalcohols.

It is possible to use proportions of polyols comprising more than two OH groups, such as, trimethylolpropane or pentaerythritol, in order to obtain suitable OH numbers and viscosities. The same applies to a slight modification, to impart elasticity, with long chain dialcohols such as 1,6-hexanediol or with aliphatic dicarboxylic acids such as adipic acid.

This esterification (the first step) is conducted in the known manner, namely azeotropically or in the melt at an elevated temperature (above 190° C.), and results in a clear product with an acid number of 0 to 50, preferably 5 to 25, and a viscosity of 200 to 3000 mPas at 25° C. as measured in a 75% solution in butyl glycol.

To impart solubility in the aqueous alkaline medium, carboxyl groups have to be introduced in addition into the polyesters which contain OH groups. For this purpose, a reaction is effected at temperatures below 190° C. with an aromatic or cycloaliphatic dicarboxylic acid which has preferably been produced, by defunctionalisation with a long chain, aliphatic hydrophobic monoalcohol, from a polycarboxylic acid comprising three or four carboxyl groups, such as, trimesic acid, hemellitic acid, prehnitic acid or mellophanic acid for example. This method is particularly simple when anhydride-containing compounds are used, such as, trimellitic anhydride, pyromellitic anhydride or corresponding hydrogenated ring systems, and when cyclopentane-tetracarboxylic anhydride or pyrazine-tetracarboxylic anhydride is used.

The polycarboxylic acids can be reacted stoichiometrically, by a two-pot method for example, with an amount of monoalcohol such that a dicarboxylic acid is obtained which is subsequently added to the polyester which contains OH groups at temperatures of about 150 to 190° C.

In practice, a single-pot method of producing the polyesters which contain carboxyl groups has proved useful in which approximately the stoichiometric amounts of monoalcohol and trimellitic anhydride are added in the given sequence to the polyester, which contains OH groups, in the first step.

Examples of monoalcohols which can be used include linear and/or branched, saturated and/or unsaturated, primary, secondary and/or tertiary alcohols, preferably primary and/or secondary alcohols. Mixtures of these alcohols can also be used, particularly isomeric mixtures. Aliphatic C6 to C18 monoalcohols are preferred, as are benzyl alcohol and alkyl-substituted products thereof. Branched chain C8 to C13 iso-monoalcohols are particularly preferred. Semi-esters which are particularly stable towards hydrolysis are obtained by the use of (α-branched monoalcohols or secondary monoalcohols, such as, cyclohexanol or secondary methyl octyl alcohol. It is ensured by the synthesis of the resins that any cleavage products which are possibly formed by hydrolysis (monoalcohols and monoesters of trimellitic acid) are electrophoretically deposited with the film without problems.

Carboxyl groups can also be incorporated, for example, by the use in conjunction during the condensation polymerisation reaction of hydroxycarboxylic acids, such as, dimethylolpropionic acid for example, the free carboxyl group of which does not generally take part in the condensation polymerisation reaction on account of steric hindrance, so that this acid is incorporated exclusively via hydroxyl groups.

The molar ratios of the overall formulation for the production of the polyesters are selected so that a viscosity is obtained which is suitable for the purpose of use in question. This viscosity, for example, is about 200 to 3000, preferably 250 to 2000 and most preferably 300 to 1500 mPas, as measured in a 50% solution in butyl glycol at 25° C. The viscosity can also be adjusted, as can the molecular weight, by admixture with resins of higher or lower viscosity or with resins of lower or higher molecular weight, respectively. The upper limit of the acid number is preferably less than 100, most preferably less than 60; the lower limit of the acid number is preferably greater than 35, most preferably greater than 40. The polyester which contains carboxyl groups contains at least one, preferably at least two carboxyl groups per molecule in order to achieve solubility in water by salt formation with a low molecular weight base. If the acid number is too low, the solubility is too low. If the acid number is too high, the high degree of neutralization gives rise to an increased extent of electrolysis in the ADL bath, which can result in surface defects. The excess of alcohol which is selected results in a hydroxyl number of about 20 to 150, preferably 60 to 120, in the finished resin. Resins are preferred which have a relatively high hydroxyl number and a low acid number.

Condensation polymerization is effected, azeotropically for example, or in the melt for example, at reaction temperatures between 160 and 240° C., preferably between 160 and 210° C. After the desired final resin values have been reached as regards viscosity and acid number, the batch is cooled to a temperature such that a product is formed which has a viscosity which ensures that water can be incorporated. In practice, this means that the melt viscosity which is reached should not exceed 40,000 mPa.s. This can be achieved by cooling to a suitable temperature. Unless the reaction is conducted under pressure, this temperature is about 100° C. at most.

To convert it into an aqueous solution or dispersion, the product of the condensation polymerization is neutralized. For this purpose, the neutralizing agent can be added to the condensation polymerization resin before or during the addition of water, or can also be contained in the water in which the polymerization resin is dispersed. High-speed agitator disc units, rotor-stator mixers or high-pressure homogenizers are used in the course of this procedure, for example. Organic solvents can optionally be removed by distillation during or after the conversion into an aqueous solution or dispersion.

Neutralizing agents which are suitable for this purpose include customary bases, such as ammonia for example; primary, secondary and tertiary amines, such as, diethylamine, triethylamine or morpholine; alkanolamines, such as diisopropanolamine, dimethylaminoethanol, triisopropanolamine or dimethylamino-2-methylpropanol; quarternary ammonium hydroxides, or optionally small amounts of alkylene polyamines also, such as, ethylenediamine. Mixture of neutralizing agents of this type can also be used.

The stability of the aqueous dispersion can be influenced by the choice of neutralizing agent. The amount of neutralizing agent is selected so that the MEQ value of the mixture of component (A) and component (B) is 50 to 70% lower than the MEQ value of the ADL bath.

Example of suitable polyacrylate resins in component (A) include copolymers which contain carboxyl groups and/or sulphonic acid groups and which have an acid number of 20 to 150 and a number average molecular weight Mn of 1000 to 10,000.

The latter are produced by customary methods, namely by the copolymerization of olefinically unsaturated monomers, wherein monomers which comprise acid groups are copolymerized with other monomers. Monomers which comprise acid groups are used in conjunction for the purpose of incorporating carboxyl and/or sulphonic acid groups in the copolymers. Due to their hydrophilic character, these groups ensure that the copolymers are soluble or dispersible in water, particularly after what is at least a partial neutralization of the acid groups.

In principle, all olefinically unsaturated, polymerisable compounds which contain at least one carboxyl and/or sulphonic group are suitable as monomers which comprise acid groups, such as, olefinically unsaturated mono- or dicarboxylic acids, e.g., acrylic acid, methacrylic acid, crotonic acid, fumaric acid, maleic acid or itaconic acid, or olefinically unsaturated compounds which contain semi-esters of fumaric acid, maleic acid and itaconic acid or sulphonic acid groups, such as 2-acrylamido-2-methylpropanesulphonic acid, for example, or any mixtures of olefinically unsaturated acids of this type. Acrylic acid and methacrylic acid are particularly preferred.

In order to achieve the desired application technology properties in the finished lacquer, the copolymers may contain other functional monomers, with which crosslinking reactions can be effected, for example, in addition to the monomers comprising acid groups. These copolymers may be self-crosslinking or may be externally crosslinkable with other components which are additionally introduced into the lacquer.

Examples of functional groups of this type include hydroxy, amino, amido, keto, aldehyde, lactam, lactone, isocyanate, epoxy and silane groups. Olefinically unsaturated monomers are known which comprise functional groupings of this type. Hydroxy and epoxy groups are particularly preferred. Furthermore, any non-functional olefinically unsaturated monomers can in principle be used in conjunction during the production of the copolymers.

Examples of suitable non-functional monomers include esters of acrylic and methacrylic acid, the alcohol components of which contain 1 to 18 C atoms, aromatic vinyl compounds, vinyl esters of aliphatic monocarboxylic acids, acrylonitrile and methacrylonitrile.

The copolymers can be produced by polymerization by customary methods. Production of the copolymers is preferably conducted in an organic solution. It is possible to use continuous or batch methods of polymerization.

Suitable solvents include aromatic compounds, esters, ethers and ketones. Glycol ethers are preferably used.

Copolymerization is generally conducted at temperatures between 80 and 180° C. using customary initiators, such as aliphatic azo compounds or peroxides for example. Customary regulators can be used for regulating the molecular weight of the polymers. After polymerization is complete, the copolymers can be neutralized as described for the condensation polymerization resins and can be converted into an aqueous solution or dispersion, whereupon the organic solvent can optionally be removed by distillation.

Examples of polyurethane resins which are suitable in component (A) include anionic polyurethane resins which contain carboxyl, sulphonic acid and/or phosphonic acid groups which are present in salt form. These are produced in the manner known in the art from polyols, polyisocyanates and optionally from chain extension agents.

The polyurethane resins can be produced either in bulk or in organic solvents which are not capable of reacting with isocyanates. They are converted into the aqueous phase by neutralization of their acid groups, as described for condensation polymerization resins. It is advisable in many cases to produce the polyurethane resins in stages.

Thus it is possible, for example, first of all to produce a prepolymer comprising acid groups and terminal isocyanate groups in organic solvents, which prepolymer, after neutralization of the acid groups with tertiary amines, is subjected to a chain extension procedure and is converted into the aqueous phase, whereupon the organic solvents can be removed by distillation.

The polyols which are used for the production of the prepolymer can be of low and/or high molecular weight and may also contain anionic groups.

Low molecular weight polyols preferably have a number average molecular weight Mn of 60 to 400 and may contain aliphatic, alicyclic or aromatic groups. They can be used as up to 30% by weight of the total polyol constituents.

Examples of suitable low molecular weight polyols include diols, triols and polyols, such as, ethylene glycol, diethylene glycol, triethylene glycol, 1,2-propanediol, 1,3-propanediol, 1,4-butanediol, 1,2-butylene glycol, 1,6-hexanediol, trimethylol-propane, castor oil or hydrogenated castor oil, pentaerythritol, 1,2-cyclohexanediol, 1,4-cyclohexanedimethanol, bisphenol A, bisphenol F, neopentyl glycol, hydroxy-pivalic acid neopentyl glycol ester, hydroxyethylated bisphenol A, hydrogenated bisphenol A and mixtures of these polyols.

High molecular weight polyols consist of linear or branched polyols with an OH number of 30 to 150. They can be used as up to 97% by weight of the total polyol constituents. They are preferably saturated or unsaturated polyester- and/or polyether diols and/or polycarbonate diols with a molecular weight Mn of 400 to 5000, or mixtures thereof.

Examples of suitable linear or branched polyether diols include poly(oxyethylene) glycols, poly(oxypropylene) glycols and/or poly(oxybutylene) glycols.

Polyesters are preferred, and are produced in the known manner by the esterification of dicarboxylic acids or anhydrides thereof with diols. In order to produce branched polyesters, small amounts of polyols or polycarboxylic acids of higher finctionality can also be used.

The groups which are capable of forming anions may originate from the polyester or can be introduced into the prepolymer by the use in conjunction of compounds which contain two active H groups which react with isocyanate groups and at least one group which is capable of forming anions. Suitable groups which react with isocyanate groups include hydroxyl groups in particular, as well as primary and/or secondary amino groups. Examples of groups which are capable of forming anions include carboxyl, sulphonic acid and/or phosphonic acid groups. Examples of compounds which contain groups such as these include dihydroxycarboxylic acids, such as, dihydroxypropionic acid, dihydroxybutyric acid, dihydroxysuccinic acid, diaminobenzoic acid and preferably $\alpha,\alpha$-dimethylolalkanoic acids, such as, dimethylolpropionic acid for example.

Suitable polyisocyanates include aliphatic, cycloaliphatic and/or aromatic polyisocyanates which contain at least two isocyanate groups per molecule, and the derivatives of these diisocyanates which are known in the art and which contain biuret, allophanate, urethane and/or isocyanurate groups, as well as mixtures of these polyisocyanates. Isomers or mixtures of isomers of organic diisocyanates are preferably used.

The polyisocyanate component which is used for the production of the prepolymer can also contain small proportions of polyisocyanates of higher functionality.

The prepolymer is advantageously produced in the presence of catalysts, such as, organotin compounds or tertiary amines for example.

The polyurethane resins are converted into the aqueous phase as described for the polyester resins, namely by neutralization of the polyurethane resin which contains acid groups with a basic neutralizing agent. Examples of basic neutralizing agents include those which were described above for the neutralization of the polyester resins.

Crosslinking of the coating composition according to the invention is preferably effected during stoving, by reaction with a crosslinking component. Crosslinking components are familiar to one skilled in the art. Examples include amino plast resins, particularly melamine-formaldehyde resins; phenoplast resins, blocked polyisocyanates or transesterification crosslinking agents such as polyesters or polyurethane esters comprising hydroxyalkyl ester groups, derivatives of acetoacetic acid or malonic acid alkyl esters, tris (alkoxycarbonylamino)triazine derivatives, and mixtures of these crosslinking components, which can give rise to highly crosslinked coatings with or without the action of catalysts. Blocked polyisocyanates are preferred.

These blocked polyisocyanates contain on average more than one isocyanate group, preferably, at least two isocyanate groups per molecule. They should be stable on storage in the aqueous phase at a pH corresponding to neutral to slightly basic conditions, should split off under the action of heat at about 100° C. to 200° C. and should crosslink with the reactive hydroxyl and/or carboxyl groups which are present in the resin system.

Blocked polyisocyanate are obtained by the reaction of polyisocyanates with mono-functional compounds comprising active hydrogen.

Suitable polyisocyanates which can be used individually or in admixture in blocked form as crosslinking agents comprise any organic di-and/or polyisocyanates which contain aliphatically, cycloaliphatically, araliphatically and/or aromatically bonded free isocyanate groups.

The preferred polyisocyanates are those which contain about 3 to 36, most preferably 8 to 15, carbon atoms. Examples of suitable diisocyanates include toluene diisocyanate, diphenylmethane diisocyanate and particularly hexamethylene diisocyanate, tetramethylxylylene diisocyanate, isophorone diisocyanate, dicyclohexylmethane diisocyanate and cyclohexane diisocyanate.

Examples of diisocyanates which are particularly suitable include "lacquer polyisocyanates" based on hexamethylene diisocyanate, isophorone diisocyanate and/or dicyclohexylmethane, wherein these also include the derivatives of these diisocyanates which are known in the art and which contain biuret, urethane, uretdione and/or isocyanurate groups.

Mono-functional compounds comprising active hydrogen which can be used for the blocking of polyisocyanates are commonly available. Example of compounds which can be used include acidic CH compounds such as acetylacetone; acidic CH esters, such as, acetoacetic acid ester or dialkyl malonates; (cyclo)aliphatic alcohols such as, n-butanol, 2-ethylhexanol or, cyclohexanone; glycol ethers, such as, butyl glycol or butyl diglycol; phenols, such as, cresol or tert.-butyl phenol; diamino alcohols, such as, dimethylaminoethanol; oximes, such as, butanone oxime, acetone oxime or cyclohexanone oxime; lactams, such as, $\epsilon$-caprolactam or pyrrolidone-2; imides; hydroxyalkyl esters; hydroxamic acids and esters thereof; and pyrazoles.

The polyisocyanates can be blocked intramolecularly with identical or different blocking agents. Mixtures of identical or different blocked polyisocyanates can also be used.

The melamine-formaldehyde resins crosslink with the hydroxyl groups of the polyester resin with the formation of ether groups. Examples of crosslinking agents such as, these include triazines, such as, melamine or benzoguanamine which are condensed with aldehydes, particularly formaldehyde, by known industrial methods in the presence of alcohols such as methanol, ethanol, propanol, butanol or hexanol. These are preferably methanol-etherified melamine resins such as Cymel®325, Cymel®327, Cymel®350, Cymel®370 or Maprenal® MF 927; butanol- or isobutanol-etherified melamine resins such as Setamin US 138 or Maprenal® MF 610 for example; and mixed-etherified melamine resins, as well as hexamethylol melamine resins in particular, such as Cymel®301 or Cymel®303.

On account of the low content of organic solvent in component (A), it is advisable to add a customary biocidal component, such as formaldehyde deposition products, phenolic compounds, organic sulphur compounds or oxidising agents, to prevent infestation by microorganisms such as bacteria, yeast, algae or fungi.

Commercially available anionically and/or non-ionically stabilized emulsifiers can also be used, in amounts up to 3% by weight calculated with respect to the solid resin, for the production of component (A). Customary lacquer adjuvant substances and additives can also be added in the usual amounts during the production of components (A). Examples thereof include optical brighteners such as derivatives of stilbene, coumarin, 1,3-diphenylpyrazoline, naphthalimide, benzoxazole and thiophene benzoxazole, customary catalysts such as those which are known to one skilled in the art for the crosslinking systems concerned; and ethoxylated or propoxylated derivatives of substituted phenols or fatty alcohols comprising more than 10 C atoms as film-forming agents.

Aqueous, pigmented component (B) contains one or more paste resins, pigments and/or extenders, neutralizing agents and water, advisedly contains a biocidal component, and also optionally contains crosslinking agents and/or customary lacquer additives and adjuvant substances such as those described for component (A) for example.

Film-forming agents can be added, for example, in amounts of up to 10% by weight with respect to the solids content of components (A) and/or (B).

They can be added to components (A) and/or (B) or to aqueous components (A) and/or (B) or to the electro-dip lacquer coating bath which is capable of forming a coating. Film-forming agents are preferably added to the binder vehicles of components (A) and/or (B) before the conversion thereof into an aqueous dispersion.

Suitable paste resins include polyester resins, polyurethane resins, polyacrylate resins and amino plastic resins, such as those described for component (A). Polyester urethane resins are preferred.

Urethanized, oil-free polyesters which contain OH groups, and which have an acid number of 10 to 50 and a number average molecular weight (Mn) of 2000 to 20,000, constitute one example of a particularly preferred embodiment. Polyester urethane resins of this type are obtained, for example, by the reaction of one or more polyester polyols, which are free from carboxyl groups and which have an OH number of 35 to 200 and a number average molecular weight of 500 to 5000, comprising 2 to 30% by weight with respect to the polyester polyol of low molecular weight diols with a molecular weight of 60 to 350, wherein a portion of the low molecular weight diols contains at least one acid group which is capable of forming anions, and comprising 0 to 6% by weight with respect to the polyester polyol of low molecular weight triols with a molecular weight of 60 to 350, with one or more diisocyanates, wherein the ratio of the OH groups of the polyester polyol, diol and triol to the NCO groups of the diisocyanate is greater than 1.0 to 1.3. Production of the polyester urethane resins is effected, for example, at temperatures of 20 to 150° C., preferably 45 to 90° C., optionally with the addition of catalysts such as organotin compounds or tertiary amines. Addition polymerization is effected in the melt or after dilution with dry solvents which do not react with isocyanate groups, after rapid mixing of the components with intensive stirring. Polymerization proceeds until practically all the isocyanate groups have reacted. The reaction can also be carried out in steps. A different procedure can also be used when step-wise production is employed. For example, the diol which forms anionic groups, such as dimethyolpropionic acid, can first be reacted with one or more diisocyanates in an organic solvent which does not react with isocyanate groups, whereupon it is reacted further with a polyester and a low molecular weight diol and/or triol which is free from anionic groups. The addition polymerization can optionally be stopped at a desired state of reaction by mono-functional additives, such as, butanone oxime, dibutylamine or an alcoholic solvent. The function of the solvent, which does not react with the isocyanate groups, is to maintain the reactants in a liquid state and to facilitate better temperature control during the reaction. Examples of suitable solvents include dimethylformamide, dimethylacetamide, 1-methyl-2-pyrrolidone, acetonitrile, tetrahydrofuran, dioxane, esters, such as, ethyl acetate and also ketones such as acetone, completely etherified mono- or diglycols of ethylene glycol or propylene glycol, as well as ketones which are substituted with methoxy groups.

Before the polyester urethane resin is converted into the aqueous phase, the aforementioned biocides, crosslinking agents and/or customary lacquer additives and adjuvant substances are optionally added thereto. This is followed by conversion into the aqueous phase as described for component (A).

Customary pigments, extenders, corrosion inhibitors and lacquer adjuvant substances can be used for the pigmentation of aqueous component (B) as long as these additives do not undergo unwanted reactions with water in the slightly basic to neutral pH range and do not drag in any water-soluble extraneous ions which cause problems.

Examples of suitable pigments include inorganic pigments, e.g. white pigments, such as, titanium dioxide, zinc sulphide, lithopone, lead carbonate, lead sulphate, tin oxide or antimony oxide; coloured inorganic pigments such as chrome yellow, nickel titanium yellow, chrome orange, molybdenum red, iron oxide red, mineral violet, ultramarine violet, ultramarine blue, cobalt blue, chromium oxide green or iron oxide black; colored organic pigments, such as, toluidine red, lithol red, perylene red, thioindigo red, quinacridone red, quinacridone violet, phthalocyanine blue, indanthrene blue or phthalocyanine green, carbon black, graphite, corrosion inhibitors, such as, zinc chromate, strontium chromate, zinc phosphate, lead silicochromate, barium metaborate and zinc borate.

Effect pigments such as aluminium bronzes, pearl gloss pigments or interference pigments can also be used. Examples of extenders which can be used include calcium carbonate, silica, aluminium silicates, magnesium silicate, mica, barium sulphate, aluminium hydroxide and hydrated silicas.

Customary adjuvant substances such as anti-foaming agents, dispersing aids and agents for controlling the rheology can also be added to aqueous, pigmented component (B).

Aqueous, pigmented component (B) is produced in the customary manner known to one skilled in the art by dispersing the pigments and adjuvant substances in the apaste resin. The composition of the constituents to achieve optimum dispersion is determined separately for each dispersing installation. Examples of suitable dispersing installations include agitator disc units, triple roller mills, ball mills or preferably sand or bead mills.

Components (A) and (B) are used for coating in a mixture ratio which ranges from 1:1 to 4:1 with respect to the weight of the aqueous components concerned.

If compensation by replenishment is effected in an ADL bath which is in operation, the two components are mixed in the aforementioned mixture ratio with the bath material. The two components can be added to the bath material simultaneously or in succession for this purpose. The components are preferably pre-mixed with part of the bath material in a customary mixer unit. A mixer unit of this type may for example be a stirred vessel, a static mixer or a rotor/stator mixer. Components (A) and (B) can also be mixed beforehand in the desired mixture ratio and used as a single-component material for compensation by replenishment.

When an ADL bath is first prepared, component (A) is treated with additional neutralizing agent in order to obtain the desired MEQ value of the ADL bath and is optionally pre-diluted with water. Thereafter, component (B) is added in the manner described above and the mixture is adjusted to the desired solids content for coating.

In another variant of the method, the necessary amount of water is first placed in the tank with the neutralizing agent and components (A) and (B) are added in the manner described above.

In continuous operation, the ADL bath has a solids content of 8 to 25% by weight, preferably 10 to 15% by weight, an MEQ value of 50 to 90, preferably 60 to 70, and a content of organic solvents which is less than 0.3% by weight.

Deposition is effected by applying a DC voltage of 50 to 500 volts for a coating time of 0.5 to 5 minutes, at an ADL bath temperature of 18 to 35° C.

The coating material is suitable for the coating of workpieces which have an electrically conducting surface, and is particularly suitable for the priming and single-coat lacquering of domestic and electrical appliances, steel furniture, building components, building and agricultural machines, automobile bodies and automobile accessories.

The following examples illustrate the invention. All parts and percentages are on a weight basis unless otherwise indicated,

EXAMPLES

1. Production of an Aqueous, Pigment-free Binder Vehicle Component Free from Crosslinking Agents (A1)

A mixture of 2.55 parts by weight dimethylethanolamine (50%) and 3 parts by weight of deionized water was added to 57.65 parts by weight of a polyester resin with an acid number of 49 and a hydroxyl number of 60 (produced from 26.17 parts by weight neopentyl glycol, 5.43 parts by weight trimethyolpropane, 10.83 parts by weight isophthalic acid, 21.45 parts by weight isodecanol and 36.12 parts by weight trimellitic anhydride) in a reaction vessel fitted with a stirrer, thermometer and reflux condenser. The batch was stirred at 100° C. for 10 minutes until homogeneous, and then 0.15 parts by weight of a commercially available biocide were likewise stirred in for 10 minutes until homogeneous. 36.65 parts by weight of deionised water were added, with stirring. The mixture was stirred for 90 minutes at 80° C. and was subsequently cooled rapidly to 25° C.

| Characteristic properties: | |
|---|---|
| solids content (30 minutes at 180° C.): | 57% |
| MEQ amine: | 29 milliequivalents amine/100 g solid resin |
| solvent content: | <0.1% |

2. Production of an Aqueous Pigment-free Binder Vehicle Containing a Crosslinking Agent (A2)

0.12 parts by weight of a commercially available non-ionic emulsifier were stirred into 47.75 parts by weight of a polyester resin with an acid number of 49 and a hydroxyl number of 60 (produced from 26.17 parts by weight neopentyl glycol, 5.43 parts by weight trimethyolpropane, 10.83 parts by weight isophthalic acid, 21.45 parts by weight isodecanol and 36.12 parts by weight trimellitic anhydride) in a reaction vessel fitted with a stirrer, thermometer and reflux condenser. 8.03 parts by weight of a solvent-free crosslinking agent (an isocyanurate of hexamethylene diisocyanate, blocked with butanone oxime) were heated beforehand to 70 to 80° C., added to the mixture and stirred in for 15 minutes until homogeneous. A mixture of 1.38 parts by weight diisopropanolamine (50%), 0.7 parts by weight aqueous ammonia and 2.60 parts by weight of deionized water was subsequently added and stirred in for 10 minutes until homogeneous.

Thereafter, 0.15 parts by weight of a commercially available biocide were added and stirred in for 10 minutes until homogeneous. 39.27 parts by weight of deionised water were added, with stirring. The mixture was stirred for 90 minutes at 80° C. and was subsequently cooled rapidly to 25° C.

| Characteristic properties: | |
|---|---|
| solids content (30 minutes at 180° C.): | 53% |
| MEQ amine: | 32 milliequivalents amine/100 g solid resin |
| solvent content: | <0.1% |

3. Production of an Aqueous, pigment-free Binder Vehicle Component containing a Crosslinking Agent (A3)

9.40 kg of a melamine resin of the hexamethylolmelamine resin type were added to 90.60 kg of aqueous binder vehicle component (A1) in a dissolver mixer with stirring, and were stirred for 30 minutes at 40° C.

| | |
|---|---|
| solids content (30 minutes at 180° C.): | 60.8% |
| MEQ amine: | 24.6 milliequivalents amine/100 g solid resin |

4. Production of a Solvent-free Paste Resin 453.5 g of a linear polyester of adipic acid and hexanediol with a hydroxyl number of 110 g, together with 37.1 g dimethylolpropionic acid, were dissolved in 134 g acetone at 50° C. in a reaction vessel fitted with an internal thermometer and reflux condenser. 159.5 isophorone diisocyanate were added in such a way that the temperature of reaction did not exceed 70° C. The temperature of reaction was maintained until an NCO number of about 0.5% and a viscosity, as measured in a 60% solution in acetone, of about 1200 mPa.s were reached. Thereafter, 10 g butyl glycol were added in order to deactivate the remaining NCO groups. The batch was subsequently neutralized with 30.0 g of a 50% dimethylethanolamine solution and an aqueous dispersion was produced with 1450 g water. The acetone was removed from the reaction mixture by distillation so that a solvent-free, aqueous polyurethane dispersion was obtained.

| Characteristic properties: | |
|---|---|
| solids content (30 minutes at 150° C.): | 30.1% |
| acid number: | 24.1 mg KOH/g |
| MEQ amine: | 26 milliequivalents amine/100 g solid resin |

5. Production of an Aqueous, Pigmented Component (B1)

In order to produce 100 kg of pigmented component (B), 56.85 kg of the paste resin were placed in a dissolver-mixer, and 21.20 kg coarse carbon black and 2.12 kg of a furnace black, as well as 19.83 aluminium hydrosilicate, were sprinkled in with stirring. The product for grinding which was thus produced was stirred for 15 minutes at 40° C. After a period of swelling of 12 hours, the material for grinding was dispersed in a coball mill under predetermined conditions.

| | |
|---|---|
| solids content (30 minutes at 180° C.): | 60.2% |
| MEQ amine: | 7.1 milliequivalents amine/100 g solid resin |

6. Production of an Aqueous, Pigmented Component (B2)

In order to produce 100 kg of pigmented component (B2), 42.00 kg of the paste resin were placed in a dissolver-mixer and 41.70 kg titanium dioxide, 7.00 kg aluminium hydrosilicate, 7.00 kg of post-treated aluminium hydrosilicate, 1.80 kg silica and 0.50 kg of a polybutylene were sprinkled in with stirring in the sequence given. The material for grinding which was thus prepared was stirred for 20 minutes at 50 to 60° C. and was subsequently dispersed in a coball mill under predetermined conditions.

| | |
|---|---|
| solids content (30 minutes at 180° C.): | 70.1% |
| MEQ amine: | 4.5 milliequivalents amine/100 g solid resin |

7. Production of a Black Electro-dip Lacquer Coating Bath pigment-free aqueous binder vehicle component containing a crosslinking agent (A3)

aqueous pigmented component (B1)

mixture ratio of component A3: component B1=3.5:1

1669.65 g of deionized water were first placed in a vessel and 7.35 g of a neutralizing agent (100% dimethylethanolamine) were added. 252 g of pigment-free aqueous binder vehicle component (A3) were subsequently added slowly, with stirring or rotation. After homogenising for 30 minutes, 71 g of aqueous pigmented component (B1) were added with stirring or circulation. After a period of homogenizing of about 1 hour, the electro-dip bath was ready to be used for coating.

Bath Properties:

| | |
|---|---|
| pH: | 8.6 |
| conductivity: | 1234 μS/cm |
| solids content (30 minutes at 180° C.): | 9.8% |
| MEQ amine: | 62.9 milliequivalents amine/100 g solids |

8. Production of a Grey Electro-dip Lacquer Coating Bath pigment-free aqueous binder vehicle component containing a crosslinking agent 25 (A2)

aqueous pigmented component (2)

mixture ratio of component A3: component B1=2.0:1

1632 g of deionised water were first placed in a vessel and 14.6 g of a neutralizing agent (50% diisopropanolamine) were added. 237.4 g of pigment-free aqueous binder vehicle component (A2) were subsequently added slowly, with stirring or circulation. After homogenizing for 30 minutes, 116 g of aqueous pigmented component (B2) were added with stirring or circulation. After a period of homogenization of about 1 hour, the electro-dip bath was ready to be used for coating.

Bath properties:

| | |
|---|---|
| pH: | 8.1 |
| conductivity: | 1094 μS/cm |
| solids content (30 minutes at 180° C.): | 10.4% |
| MEQ amine: | 47.7 milliequivalents amine/100 g solids |

What is claimed is:

1. A method for anodic electro-dip lacquer coating, wherein coating medium which is consumed in an anodic electro-dip bath is compensated for by an under-neutralized anodic replenishment material, where in the replenishment material comprises:

A) a pigment-free aqueous binder vehicle component with a solid content of 40 to 70% by weight, based on the weight of the vehicle component, an MEQ value of 15 to 40 and a content of organic solvent of 0.5% by weight based on the weight of the vehicle component, and B) a pigment-containing aqueous paste resin component with a solid content of 60 of 75% by weight, based on the weight of the resin component, an MEQ value of 5 to 15 and a content of organic solvent of 1.0% by weight, based on the weight of the resin component, wherein A) and B) are present in a ratio by weight of 1:1 to 4:1 and the mixture of A) and B) has a solid content of 45 to 73% by weight based on the weight of the mixture of A) and B), and an MEQ value which is 50 to 70% lower than the MEQ value of the electro-dip bath.

2. A method according to claim 1, wherein component A) and/or component B) contain one or more customary biocidal agents.

3. A method according to claims 1 or 2, wherein component A) contains one or more film-forming binder vehicles, emulsifiers, and/or Customary lacquer adjuvant substances and optionally, contains one or more crosslinking agents.

4. A method according to claim 3, wherein component B) contains one or more paste resins, pigments and/or extenders and/or customary lacquer adjuvant substances, and optionally, contains one or more crosslinking agents.

5. A method according to claim 1, wherein it is carried out for the coating of industrial products or motor vehicle bodies or parts thereof.

6. A method according to claim 1, wherein it is carried out without electrodialysis of the electro-dip lacquer bath.

* * * * *

UNITED STATES PATENT AND TRADEMARK OFFICE

CERTIFICATE OF CORRECTION

PATENT NO. : 6,350,358 B1 
DATED : February 26, 2002
INVENTOR(S) : Eduard Ehmann et al.

It is certified that error appears in the above-identified patent and that said Letters Patent is hereby corrected as shown below:

Column 16,
Line 27, replace “an MEQ” with -- a MEQ --.
Line 28, replace “0.5%” with -- ≤0.5% --.
Line 33, replace “an MEQ” with -- a MEQ --.
Line 34, replace “1.0%” with -- ≤1.0% --.
Line 39, after A) and B) insert -- , a solvent content of ≤ 0.75% by weight --.
Line 39, replace “an MEQ” with -- a MEQ --.
Line 49, replace “claim 3” with -- claim 1 or 2 --.

Signed and Sealed this

Fifth Day of November, 2002

*Attest:*

*Attesting Officer*

JAMES E. ROGAN
*Director of the United States Patent and Trademark Office*